US005906754A

United States Patent [19]

Appel et al.

[11] Patent Number: 5,906,754

[45] Date of Patent: May 25, 1999

[54] APPARATUS INTEGRATING PAD CONDITIONER WITH A WAFER CARRIER FOR CHEMICAL-MECHANICAL POLISHING APPLICATIONS

[75] Inventors: Andrew Thorton Appel, Dallas; Michael Francis Chisholm, Plano, both of Tex.

[73] Assignee: Texas Instruments Incorporated, Dallas, Tex.

[21] Appl. No.: 08/729,660

[22] Filed: Oct. 21, 1996

[51] Int. Cl.[6] ..... B24B 37/00; B24B 7/00; B24B 1/00

[52] U.S. Cl. ..... 216/88; 438/692; 156/345

[58] Field of Search ..... 156/345; 451/287; 216/88, 89; 438/692, 693

[56] References Cited

U.S. PATENT DOCUMENTS

| | | | |
|---|---|---|---|
| 5,032,203 | 7/1991 | Doy et al. | 156/345 |
| 5,216,843 | 6/1993 | Breivogel et al. . | |
| 5,329,732 | 7/1994 | Karlsrud et al. . | |
| 5,522,965 | 6/1996 | Chisholm | 156/636.1 |
| 5,536,202 | 7/1996 | Appel et al. | 451/285 |
| 5,569,062 | 10/1996 | Karlsrud | 451/285 |
| 5,688,364 | 11/1997 | Sato | 451/287 X |
| 5,749,771 | 5/1998 | Isobe | 451/285 X |

FOREIGN PATENT DOCUMENTS

| | | | |
|---|---|---|---|
| 3625286 A1 | 7/1986 | Denmark | B24B 55/02 |
| 59134650 | 12/1984 | Japan | B24B 53/00 |
| WO 95/18697 | 7/1995 | WIPO | B24B 1/00 |

*Primary Examiner*—Thi Dang
*Attorney, Agent, or Firm*—Mark A. Valetti; Carlton H. Hoel; Richard L. Donaldson

[57] ABSTRACT

An apparatus integrating pad conditioning device (44) with a wafer carrier device (24) for chemical-mechanical polishing applications includes an attaching mechanism (45) for associating conditioning device (44) with wafer carrier device (24). Conditioning surface (84) of conditioning device (44) conditions the polishing pad associates with attaching mechanism (45). Carrier device (24) receives and holds wafer (42) so that wafer (42) and conditioning surface (44) contact the polishing pad (42) to simultaneously condition polishing pad (26) and polish wafer (42).

18 Claims, 4 Drawing Sheets

APPARATUS INTEGRATING PAD CONDITIONER WITH A WAFER CARRIER FOR CHEMICAL-MECHANICAL POLISHING APPLICATIONS

TECHNICAL FIELD OF THE INVENTION

The present invention relates to a method and system for fabricating a semiconductor wafer and, more particularly, to apparatus that integrates a pad conditioner with a wafer carrier for chemical-mechanical polishing applications and including a method for using the apparatus.

BACKGROUND OF THE INVENTION

Advances in electronic devices generally include reducing the size of components that form integrated circuits. With smaller circuit components, the value of each unit area on a semiconductor wafer becomes higher because the ability to use all of the wafer area for circuit components improves. To properly form an integrated circuit with advanced circuit designs that use higher percentages of the wafer area for smaller components, it is critical that defect counts on the semiconductor wafer be reduced below levels which were previously acceptable for many circuit designs. For example, minute particles of less than 0.2 microns are unacceptable for many of the current advanced circuit designs. This is because the small particles or defects can damage the integrated circuit by shorting out two or more circuit lines or by cutting or otherwise impairing the operation of these circuits. In order to improve the overall planarity of a semiconductor wafer and to improve the immunity of the wafer to certain types of defects, a process known as chemical mechanical polish (CMP) has become popular.

CMP is a process for improving the surface planarity of a semiconductor wafer and involves the use of mechanical pad polishing systems usually with a silica-based slurry. CMP offers a practical approach for achieving the important advantage of global wafer planarity. CMP systems for global planarization have certain limitations.

A significant limitation of existing CMP systems relates to a part of the system known as the polishing pad. The polishing pad contacts the semiconductor wafer and polishes the wafer. A slurry is usually applied to the polishing pad to lubricate the interface between the wafer and the polishing pad. The slurry also serves the function, because of its silica content, of mildly abrading or affecting the surface of the semiconductor wafer. In addition to the silica, the potassium hydroxide that the slurry contains catalyzes and helps break atomic bonds in the slurry. This further helps to increase the polishing rate for the semiconductor wafer. Most polishing pads are formed of a cellular microstructure polymer material. This material between its cells has numerous voids and pockets that the slurry may fill. As the slurry contacts the semiconductor wafer, it picks up particles and absorbs them.

A problem that often occurs with these particles and the slurry within the cell structure of the pad is a densification of the slurry within the voids. To overcome this problem, most CMP systems use a polishing pad conditioner that rakes or scratches the pad surface to remove the slurry within the pad cellular structure and, in effect, "renew" the polishing pad surface. The pad conditioners are only partially effective because used or contaminated slurry remains within the voids of the polishing pads cellular structure.

Another problem with CMP systems that use pad conditioners of a conventional type is that they are controlled by a robotic arm or other similar mechanism that places the pad conditioner in contact with the polishing pad. These conditioners may be either post polish or in situ systems that typically constitute a computer-controlled robot arm with X-Y movement in an arc and limited Z movement to position the conditioning head and determine downward force. These arms require a mounting plate at the periphery of the polishing platen and a rinse station to clean the head after conditioning. This adds complexity and additional space to the polishing tool as well as additional software control complexity. The post polish conditioners do not correct pad glazing during the duration of the polish. In situ pad conditioners have been cumbersome to implement and can be tool reliability limiters. As they condition the polishing pad the conditioners sweep across the polishing pad to condition the pad prior to the pad contacting the semiconductor wafer. Because of the sweep of the robotic arm and the need to maintain a high degree of prepared surface in contact with the semiconductor wafer, the polishing pad must be large. In many CMP systems, the polishing pad is often many times the area of the semiconductor wafer.

These problems with known polishing pads cause polishing rate to vary according to the condition of the polishing pad, which seriously affects and can degrade uniformity. The result is a far less robust polishing process that may even contribute to lower yields in the semiconductor device circuits.

SUMMARY OF THE INVENTION

Therefore, a need has arisen for an improved CMP system that consumes process materials at a rate substantially lower than the rate of conventional systems.

There is a need for an improved method and system for CMP processing that avoids slurry deposits on the polishing pad more effectively than do current CMP methods and systems.

There is yet a further need for a method and system that conditions a polishing pad more effectively than do conventional CMP systems and methods and without the abrasive effects of techniques such as those involving the use of sandpaper and diamond scratch devices.

There is still a further need for an improved method and system for CMP processing that allows the use of a smaller diameter polishing pad or at least incorporates a simpler CMP process that eliminates the need for a robotically controlled conditioner having a conditioning surface.

Accordingly, the present invention provides a method and system for CMP processing of a semiconductor wafer that substantially eliminates or reduces disadvantages and problems associated with previously developed CMP methods and systems.

More specifically, the present invention provides an integrated water carrier and conditioning device for insitu conditioning of the polishing pad for chemical-mechanical polishing applications. The carrier device holds the semiconductor wafer during the CMP process. According to the present invention, a conditioning surface is an integrated part of the carrier device and conditions the polishing pad. The wafer carrier holds the wafer so that the wafer and the polishing pad conditioning surface contact the polishing pad simultaneously. This simultaneously conditions the polishing pad and polishes the semiconductor wafer. In the preferred embodiment, the conditioning surface and wafer area are approximately circular in shape with the conditioning surface generally surrounding the wafer area.

The conditioning surface may be a toothed crystalline-substrate surface having a plurality of teeth that are of a dimensional spacing and size comparable to the dimensional spacing and size of the cell structure of the polishing pad.

Another embodiment of the carrier device of the present invention includes an ultrasonic emitter that directs ultrasonic energy to the polishing pad for dislodging slurry deposits from within and on the polishing pad. In systems where the polishing pad moves relative to the carrier device (i.e., relative motion in the sense that either the polishing pad moves or the carrier device moving, or both), the conditioning surface may condition a selected area on the polishing pad immediately before or after the selected area contacting and polishing the wafer. The conditioning surface may also attach to the carrier device so that when the carrier device rotates or moves during the CMP process, the conditioning surface also rotates or moves at essentially the same rotational speed as does the semiconductor wafer.

A technical advantage of the invention is that it extends the life of a polishing pad. This is in part due to the fact that the carrier device with the conditioning surface more effectively removes slurry deposits that may arise during the CMP process. Because present invention extends the polishing pad life, the polishing pad cost per wafer decreases. This promotes substantial cost savings in wafer fabrication processes.

Another technical advantage of the present invention is that the conditioning surface preferably surrounds and attaches to the carrier device. This eliminates the need for a robotic arm and end effector that conditions the polishing pad. The elimination of software to control the robotic arm, as well as the electrical and mechanical components of the robotic arm of conventional conditioners, makes possible substantial space savings and a simpler CMP process.

Another technical advantage of the present advantage is that it may incorporate numerous different types of conditioning surfaces. For example, one surface may be a polycrystalline substrate having a plurality of scrubbing teeth, each having a cell structure similar in size to that of the polishing pad cell structure. Alternatively, the conditioning surface may be, for example, an ultrasonic sound source that by ultrasonic sound dislodges spent or used slurry within the polishing pad cell structure as well as from the polishing pad surface. Because the conditioning device of the present invention can condition the polishing pad immediately after polishing of the semiconductor wafer, slurry does not have an opportunity to deposit and become hard or dense in the polishing pad cellular structure.

Still another technical advantage that the present invention provides is improved polishing pad conditioning uniformity. Improved polishing pad conditioning uniformity produces more uniformly polished semiconductor wafers. Consequently, the yield of the semiconductor devices increases, thereby increasing the overall profitability of the semiconductor drive fabrication process.

BRIEF DESCRIPTION OF THE DRAWINGS

For a more complete understanding and the advantages thereof, reference is now made to the following description which is to be taken in conjunction with the accompanying drawings in which like reference numerals indicate like features and wherein.

DETAILED DESCRIPTION OF ILLUSTRATIVE EMBODIMENTS

Preferred embodiments of the present invention are illustrated in the FIGURES wherein like numerals are used to refer to like and corresponding parts of the various drawings.

Figure 1:
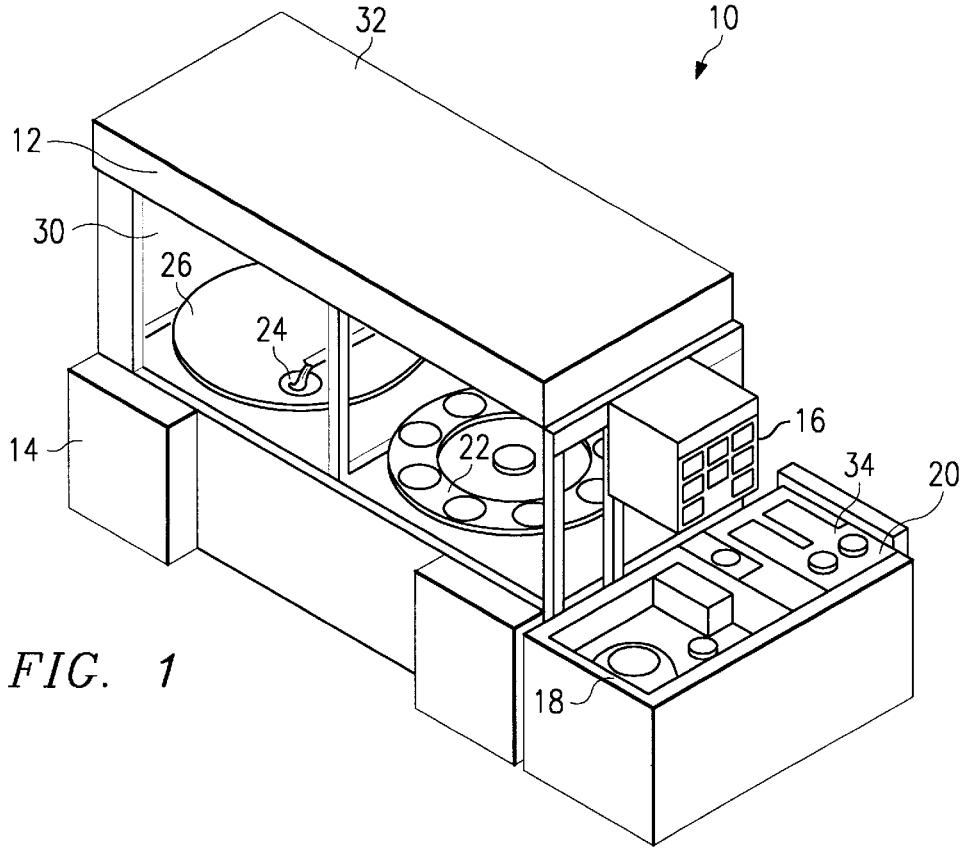
FIG. 1 shows a chemical mechanical polish (CMP) system for employing the present embodiment of the invention.

FIG. 1 shows CMP system 10 that may use the present embodiment of the invention. CMP system includes cabinet 12 on frame 14. Attached to cabinet 12 is touch screen interface 16. Input module 18 and output cassette 20 associate with cabinet 12 for supplying and receiving semiconductor wafers. Frame 14 includes necessary cabinets and access panels for the mechanical and electrical components within cabinet 12, input module 18 and output cassette 20. Cabinet 12 establishes a clean environment in which semiconductor wafers may be transferred to index table 22 which rotates to make accessible a semiconductor wafer to carrier device 24. Carrier device 24 picks up a semiconductor wafer from index table 22 and places it in contact with polishing pad 26. Polishing pad 26 rotates on polishing platen 28. Access doors 30 (normally formed of glass) and filter arrangement 32 isolate the CMP process in cabinet 12 from the external environment. Output water track 34 and output cassette 20 work together to receive semiconductor wafers from index table 22 and store these wafers in a deionized water bath.

Figure 2:
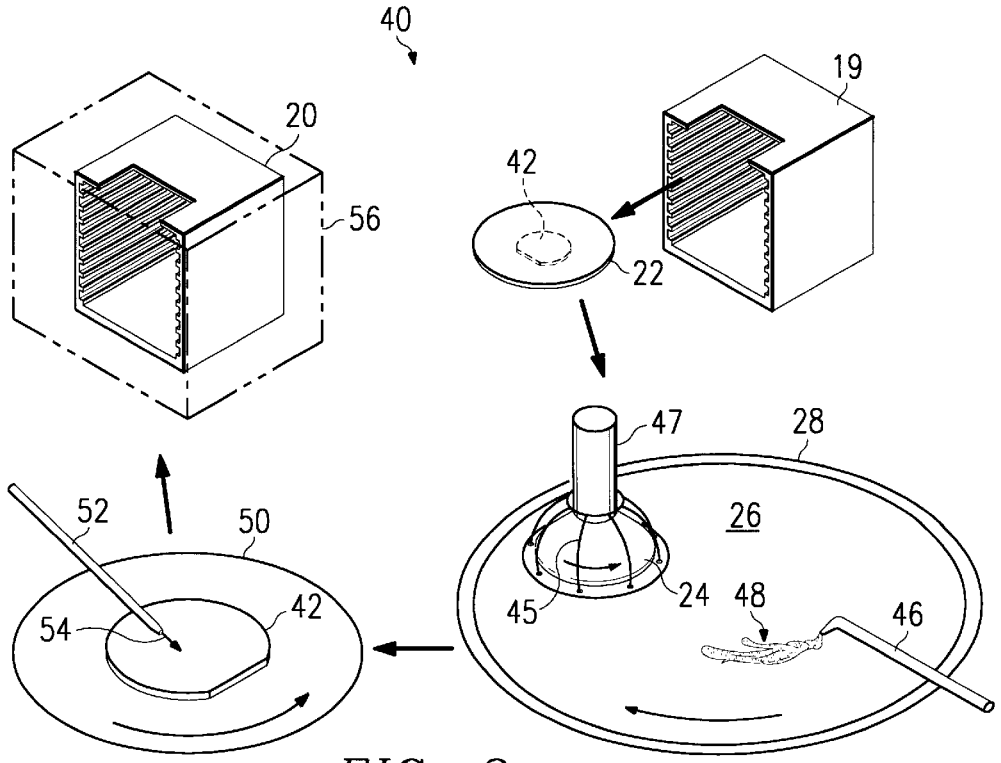
FIG. 2 illustrates an process flow according to the CMP process of the present embodiment.

FIG. 2 provides process flow 40 to more particularly illustrate that CMP process which the present embodiment supports. Referring to FIG. 2, process flow 40 begins when semiconductor wafer 42 is removed by CMP system 10 from load cassette 19 which is a part of input module 18. From load cassette 19, semiconductor wafer 42 goes to index table 22 which transfers semiconductor wafer to carrier device 24. From index table 22, semiconductor wafer 42 carrier device 24 picks up which includes conditioning device 44. In the present embodiment, conditioning device 44 surrounds carrier device 24. Although there are many ways to attach conditioning device 44 to carrier device 24, the present embodiment uses attaching mechanism 45 which attaches to arm 47 of carrier device 24.

Arm 47 may work with a control system for controlling the CMP process to assure proper downward force of conditioning device 24 on polishing pad 26. Moreover, carrier device 24 and conditioning device 44 may be associated to permit the application of differing downward forces. Accordingly, conditioning device 44 may apply greater downward force to polishing pad 26 than does carrier device 24, or vice versa, as the polishing requirements of wafer 42 and conditioning requirements of polishing pad 26 differ. A variety of well-known mechanical configurations and techniques can be applied to produce the desired differing downward forces between carrier.

During conditioning, primary platen 28 and polishing pad 26 rotate as a unit. As primary platen 28 and conditioning pad 26 rotate, slurry applicator 46 applies slurry 48 to polishing pad 26. As polishing pad 26 continues to rotate, the portion of polishing pad 26 that just received slurry 48 first comes in contact with conditioning surface 44. Conditioning surface 44 conditions polishing pad 26. Immediately thereafter, the conditioned portion of polishing pad 26 comes in contact with semiconductor wafer 42. Polishing pad 26 then polishes semiconductor wafer 42. Immediately after polishing semiconductor wafer 42, that portion of polishing pad 26 which just contacted semiconductor wafer 42 again contacts conditioning surface 44 for reconditioning. The surface then rotates so that new slurry 48 may be applied by slurry applicator 46.

After conditioning surface 44 conditions polishing pad 26, device 24 transfers semiconductor wafer 42 to final platen 50 where water applicator 52 may apply a water stream 54 to rinse off residual slurry 48 from semiconductor wafer 42. Thereafter, carrier device 24 transfers semiconductor wafer 42 to output cassette 20 within deionized water bath 56 as described and associated with FIG. 1.

Figure 3:
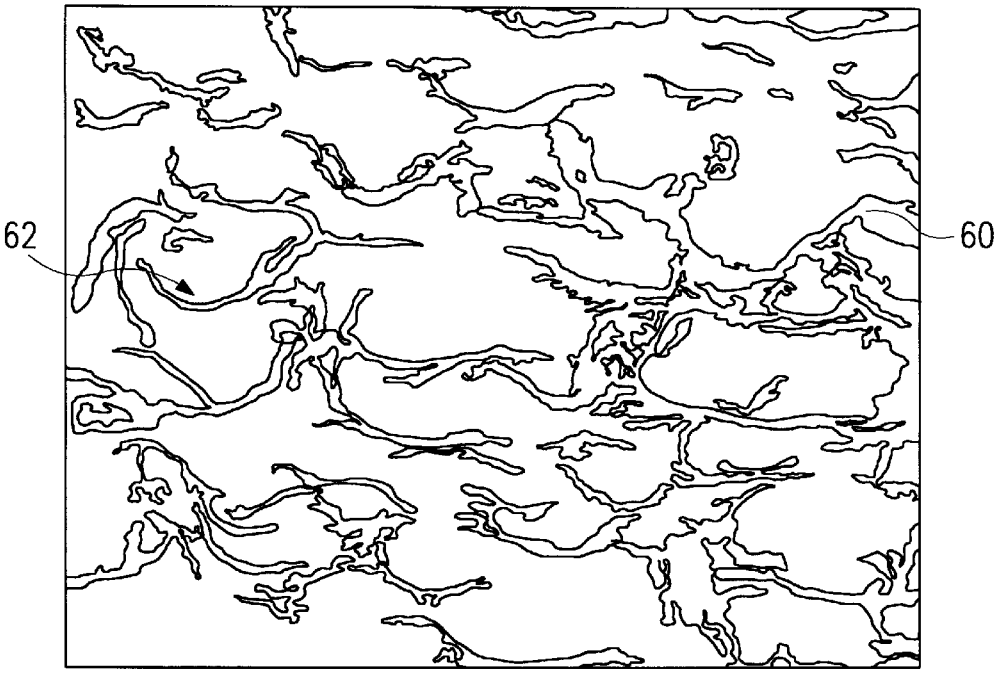
FIG. 3 illustrates a photomicrograph of a new polishing pad for polishing a semiconductor wafer.
Figure 4:
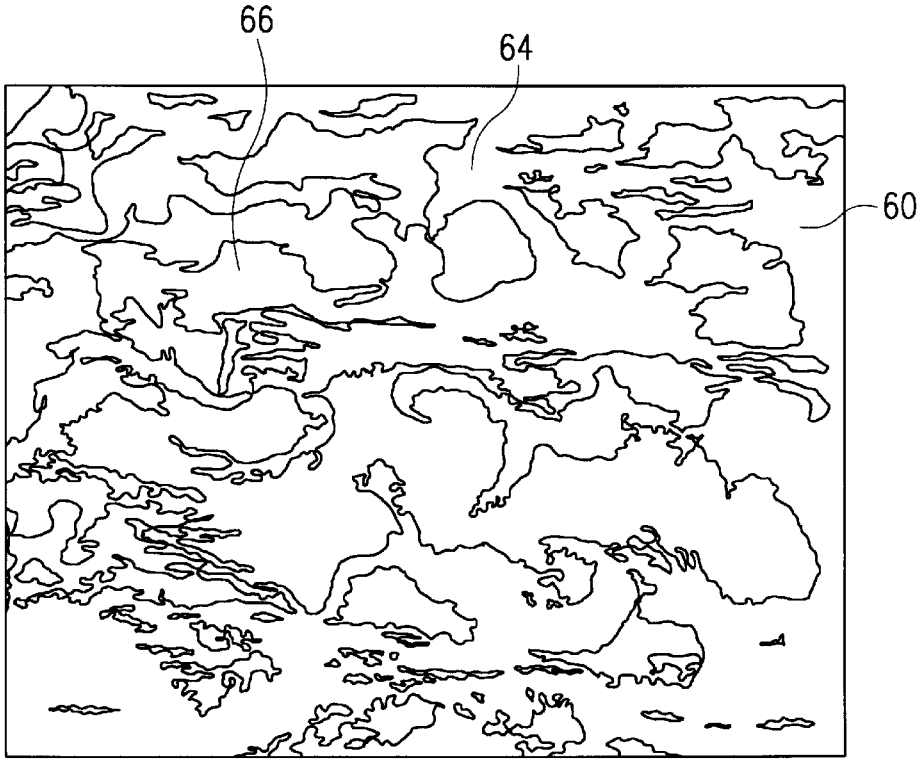
FIG. 4 illustrates a polishing pad similar to that of FIG. 3 after numerous CMP processes that illustrates the deterioration of the pad as well as the glazed areas in the pad microcellular structure.

Without the present embodiment, polishing pad 26 becomes clogged with slurry 48 and wafer 42 deposits. These deposits inhibit proper CMP processing. In particular, FIGS. 3 and 4 illustrate a phenomenon that the present embodiment addresses. One example of the FIG. 3 shows a new polishing pad 26 surface 60 that includes a plurality of microstructure cells 62 that may receive slurry 48 for polishing semiconductor wafer 42. In contrast, FIG. 4 depicts a polishing pad 26 surface 60 following the polish of approximately one hundred (100) semiconductor wafers 42. As FIG. 4 depicts, slurry 48 has formed numerous deposits such as deposit 64 and in some instances has filled microstructure cells such as microstructure cell 66. The result of these slurry deposits is a glazing of the polishing pad 26 surface and ultimately the uselessness of polishing pad 26. This significantly increases in the processing costs of the semiconductor wafers.

To remedy the problem that FIGS. 3 and 4 depict, the present embodiment applies to wafer carrier 24 conditioning device 44.

Figure 5:
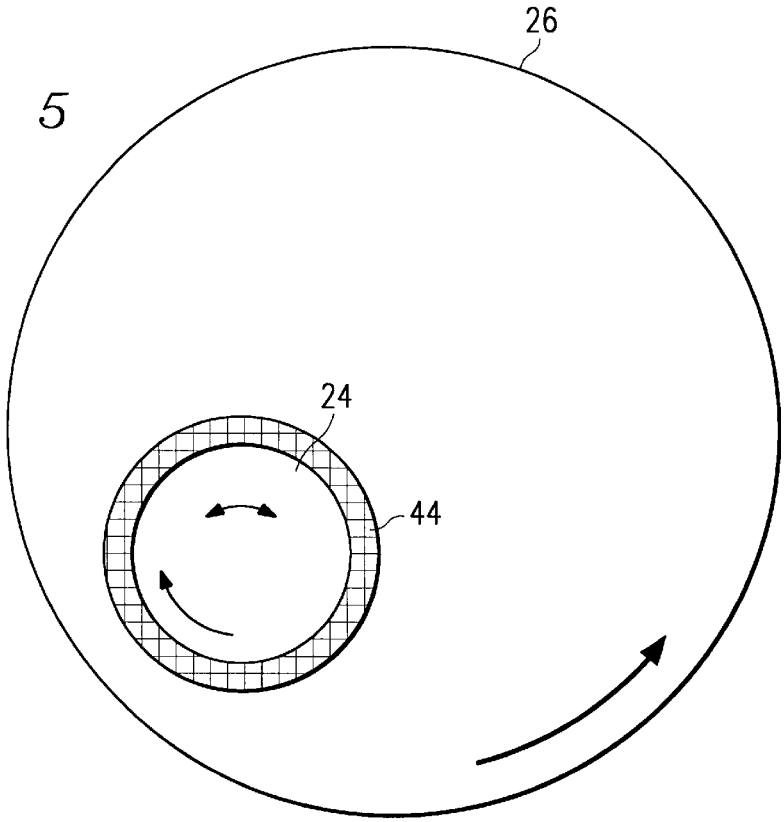
FIGS. 5 and 6 conceptually illustrate one embodiment of the invention.
Figure 6:
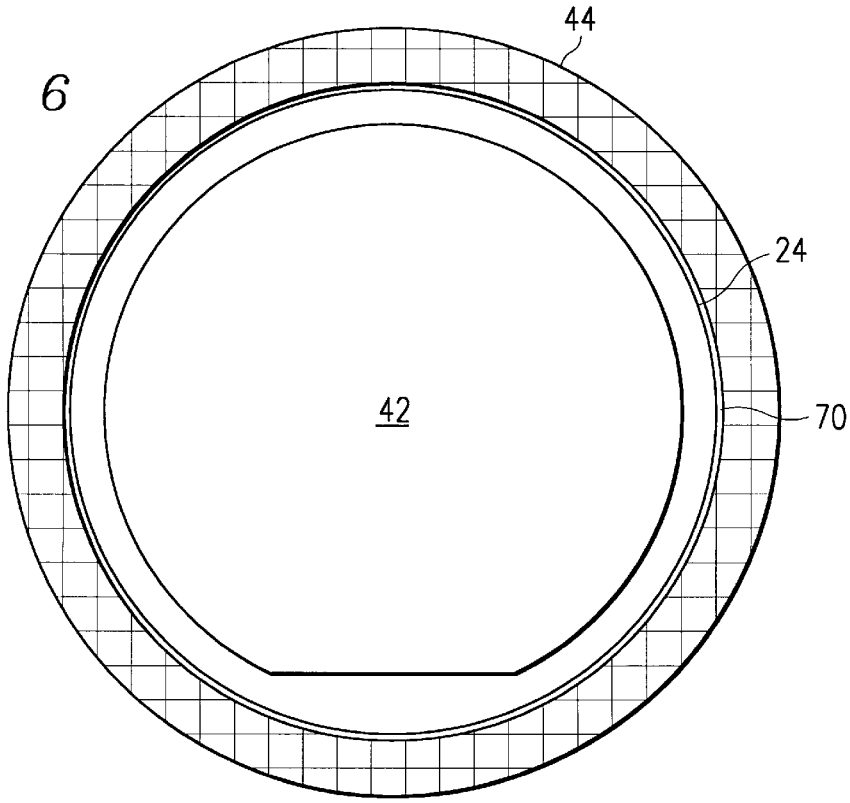

FIGS. 5 and 6 illustrate one system that may include conditioning device 44 in association with carrier device 24. In FIG. 5, wafer 42 is held in place by carrier device 24. Conditioning ring 44 surrounds carrier device 24. Space 70 between carrier device 24 and conditioning device 44 indicates that conditioning ring 44 is free to rotate relative to carrier device 24 as desired. However, a collar or other mechanism (not shown) may be used to attach conditioning device 44 to carrier device 24. Conditioning device 44 includes a conditioning surface that may take one of several forms as appears in FIGS. 7, 8, and 9 discussed below. The conditioning device that the present embodiment provides also may take several other forms. Various embodiments of the present invention include incorporating within conditioning device 44 a ring transducer that directs ultrasonic energy into polish pad 26. This will loosen from polish pad 26 slurry deposits and permit unused slurry to be absorbed by polish pad 26.

Figure 7:
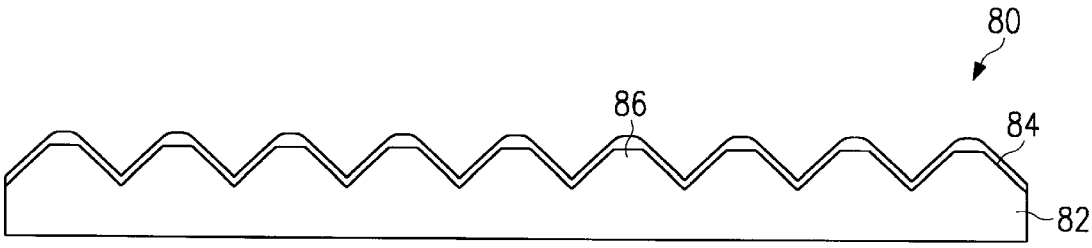
FIG. 7 illustrates a side view of one conditioning surface usable with the present embodiment.

Instead of or in addition to the use of an ultrasonic transducer mechanism within conditioning device 44, the surface of conditioning device 44 may include crystallographic structures that have a dimension comparable to the microcell structure of a polishing pad. For example, FIG. 7 shows a cross section of a crystalline structure 80 that may serve as a surface for conditioning device 44 that contacts polish pad 26. In particular, crystallographic structure 80 includes crystalline substrate 82 on which a coating 84 is deposited. Crystalline substrate 82 includes teeth 86 that can nondestructively scrub slurry from the cellular microstructure of polish pad 26.

Figure 8:
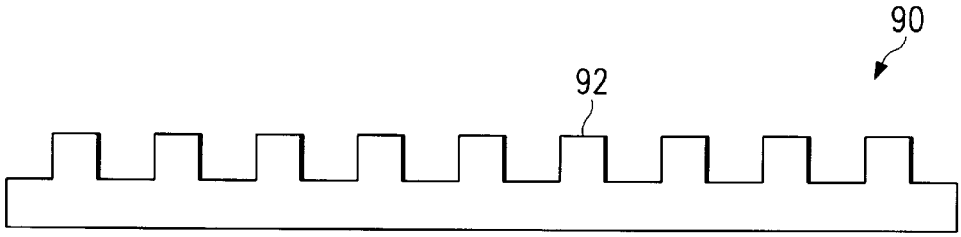
FIG. 8 illustrates an enlarged cross section of a portion of another embodiment of the present invention.

FIG. 8 shows another scrubbing surface 90 that may be attached or made part of conditioning device 44. Scrubbing device 90 includes scrubbing teeth 92 that also nondestructively scrub surface 60 of polish pad 26. Still another embodiment of a scrubbing surface for conditioning device 44 appears as scrubbing surface 100 of FIG. 9. Scrubbing surface 100 may be formed from an amorphous or crystalline substrate and includes the more mildly scrubbing teeth 102 for scrubbing polish pad 26 surface.

Figure 9:
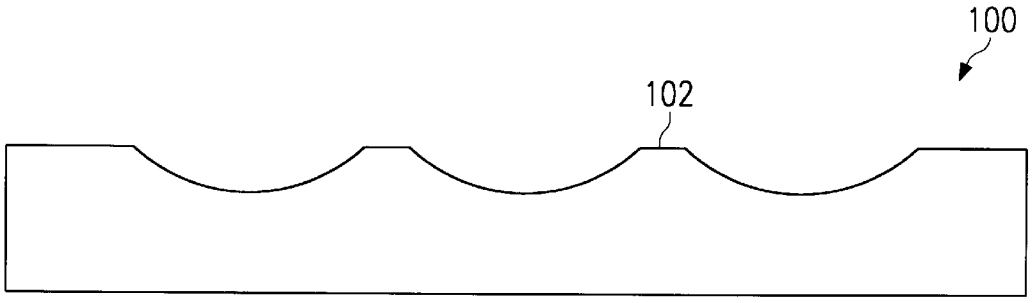
FIG. 9 depicts a cross-sectional view of another embodiment of the present invention.

The various toothed or rough structures of FIGS. 7, 8 and 9 for the surface of conditioning device 44 may be formed by known semiconductor device fabrication processes such as standard photo lithography and plasma etch processes to etch an amorphous or crystalline substrate. These processes are described in detail in U.S. patent application Ser. No. (TI-18583), entitled, "Application of Semiconductor Integrated Circuit Fabrication Techniques to the Manufacture of a Conditioning Head Pad Conditioning During Chemical-Mechanical Polish," which is here expressly incorporated by reference.

In the first method of FIG. 7, the crystalline substrate is coated with a photo resist to a desired pattern. The second method which FIG. 8 describes is a plasma definition on amorphous substrate. The FIG. 9 embodiment is similar to that of FIG. 7, however, forming embodiment 100 of FIG. 9 uses an isotropic etch that results in a smoother conditioning feature profile and potentially less physical wear on conditioning pad 26 during conditioning.

In summary, the present invention provides a method for chemical mechanical polishing of a semiconductor wafer that includes conditioning device for conditioning the chemical mechanical polishing pad. The conditioning device includes an attaching mechanism for associating the conditioning device with wafer carrier device. A conditioning surface of the conditioning device conditions the chemical mechanical polishing pad. A wafer area associates with the wafer so that the wafer and the conditioning surface contact the chemical mechanical polishing pad and simultaneously condition chemical mechanical polishing pad and polish the semiconductor wafer.

Although the invention has been described in detail herein with reference to the illustrative embodiments, it is to be understood that this description is by way of example only and is not to be construed in a limiting sense. For example, the present invention may provide numerous conditioning devices around numerous carrier devices in a single CMP polishing system. Moreover, different forms of teeth on various surfaces for carrier device 44 may be formed and still be within the scope of the present invention.

It is to be further understood that numerous changes in the details of the embodiments of the invention and additional embodiments of the invention, will be apparent to, and may be made by, persons of ordinary skill in the art having reference to this description. It is contemplated that all such changes and additional embodiments are within the spirit and the true scope of the invention as claimed below.

What is claimed is:

1. A method for performing a CMP process on a wafer, comprising the steps of:

contacting the wafer with a carrier device and a polishing pad;

associating a conditioning surface of the carrier device with the polishing pad at the same time that the wafer contacts the carrier device and the polishing pad for simultaneously polishing the wafer with the polishing pad and conditioning the polishing pad with the conditioning surface; and conditioning the polishing pad with a toothed crystalline-substrate conditioning surface comprising a plurality of teeth, each of said teeth comprising dimensional spacing and size comparable to the cell structure dimensions and spacing of the polishing pad.

2. The method of claim 1, further comprising the step of simultaneously polishing the wafer and conditioning the polishing pad with a conditioning region with a conditioning surface that surrounds the wafer.

3. The method of claim 1, further comprising the step of conditioning the polishing pad by directing ultrasonic energy to the polishing pad to dislodge slurry deposits from within and on the polishing pad.

4. The method of claim 1, wherein the polishing pad moves relative to the wafer and further comprising the step of conditioning a predetermined area of the polishing pad immediately prior in time to the time at which selected area contacts and polishes the wafer.

5. The method of claim 1, wherein the polishing pad moves relative to the wafer and further comprising the step of conditioning a selected area of the polishing pad at a time immediately following the time at which the selected area contacts and polishes the wafer.

6. The method of claim 1, wherein the carrier device rotates at a selected speed and in a selected direction relative to the polishing pad and further comprising the step of rotating the conditioning surface in association with the carrier device.

7. An apparatus integrating a wafer carrier and polishing pad conditioner for chemical-mechanical polishing applications, comprising:

a conditioning device for conditioning the polishing pad;

a carrier device for holding the wafer and associated with said conditioning surface so that the wafer and said conditioning surface may be placed in contact with the polishing pad as a unit for simultaneously conditioning the polishing pad and polishing the wafer;

and wherein said conditioning device further comprises a conditioning surface comprising a toothed crystalline-substrate conditioning surface comprising a plurality of conditioning teeth each comprising dimensional spacing and size comparable to the cell structure dimensions and spacing of the polishing pad.

8. The apparatus of claim 1, wherein said conditioning device is essentially circular and further wherein said carrier device is an approximately circular area surrounded by said conditioning device.

9. The apparatus of claim 1, wherein said conditioning device comprises an ultrasonic emitter for directing ultrasonic energy to said polishing pad for dislodging slurry deposits from within the polishing pad cellular structure.

10. The apparatus of claim 1, wherein said wafer moves relative to the polishing pad and said conditioning device conditions a selected area on the polishing pad immediately prior in time to the time at which said selected area contacts and polishes the wafer.

11. The apparatus of claim 1, wherein said conditioning device conditions a selected area on the polishing pad immediately following said selected area contacting and polishing the wafer.

12. The apparatus of claim 1, wherein said conditioning device attaches to the carrier device such that said condition surface rotates in correspondence with the rotation of said carrier device.

13. A CMP system for polishing a wafer, comprising:

a carrier device for holding the wafer;

a platen for rotating at a predetermined speed and direction;

a polishing pad associated with said platen for polishing the wafer;

a slurry coating for lubricating said polishing pad as the wafer contacts the polishing pad and further for mildly abrading and polishing the wafer; and said carrier device further for conditioning said polishing pad and comprising a conditioning surface for conditioning the polishing pad, said carrier device holds the wafer so that the wafer and said conditioning surface contact said polishing pad for simultaneously conditioning said polishing pad and polishing the wafer;

and wherein said conditioning surface comprises a toothed crystalline-substrate conditioning surface comprising a plurality of teeth each comprising a dimensional spacing and size comparable to the dimensional spacing and size of the cell structure of said polishing pad.

14. The system of claim 13, further comprising a plurality of said carrier devices for simultaneously polishing a plurality of wafers on said polishing pad while separately and simultaneously conditioning each position on said polishing pad associated with each of said plurality of wafers.

15. The system of claim 13, wherein said conditioning surface is an approximately annular disk and further wherein said carrier device is an approximately circular disk nestled within said conditioning surface.

16. The system of claim 13, wherein said conditioning surface comprises an ultrasonic emitter for directing ultrasonic energy to said polishing pad for dislodging slurry deposits from within and on said polishing pad.

17. The system of claim 13, wherein said carrier device rotates and further wherein said attaching mechanism attaches said conditioning surface to the carrier device such that, as said carrier device rotates, said conditioning surface rotates in association with said carrier device.

18. An apparatus integrating a wafer carrier and polishing pad conditioner for chemical-mechanical polishing applications, comprising:

a conditioning device for conditioning the polishing pad;

a carrier device for holding the wafer and associated with said conditioning surface so that the wafer and said conditioning surface may be placed in contact with the polishing pad as a unit for simultaneously conditioning the polishing pad and polishing the wafer; and an independent control mechanism for independently controlling the downward force of said conditioning device and the downward force of said carrier device.

* * * * *

UNITED STATES PATENT AND TRADEMARK OFFICE

CERTIFICATE OF CORRECTION

PATENT NO. : 5,906,754
DATED : May 25, 1999
INVENTOR(S) : Andrew Thornton Appel, et. al.

It is certified that error appears in the above-identified patent and that said Letters Patent is hereby corrected as shown below:

Title page, insert the following:

"Related U.S. Application Data"

-- [60] Provisional application No. 60/005,788 Oct. 23, 1995--

Column 1, line 5, insert the following:

-- Cross Reference To Related Application
Reference is made to and priority claimed from U.S. Provisional application Ser. No. 60/005,788, filed Oct. 23, 1995--.

Signed and Sealed this

Twenty-seventh Day of June, 2000

*Attest:*

Q. TODD DICKINSON

*Attesting Officer*

*Director of Patents and Trademarks*